United States Patent [19]

Griffin

[11] 4,447,998

[45] May 15, 1984

[54] FLOOR PANEL

[76] Inventor: Kary A. Griffin, 6837 Fisher Rd., Dallas, Tex. 75214

[21] Appl. No.: 355,127

[22] Filed: Mar. 5, 1982

[51] Int. Cl.[3] ..... E04B 2/28

[52] U.S. Cl. ..... 52/126.6; 52/263; 52/802

[58] Field of Search ..... 52/803, 804, 805, 806, 52/126.6, 263, 802

[56] References Cited

U.S. PATENT DOCUMENTS

| | | | |
|---|---|---|---|
| 2,607,447 | 8/1952 | Tuttle | 52/806 |
| 3,110,370 | 11/1963 | Wulf, Jr. et al. | 52/802 |
| 3,696,578 | 10/1972 | Swensen et al. | 52/126.6 |
| 3,811,237 | 5/1974 | Bettinger | 52/126.6 |
| 4,067,156 | 1/1978 | Downing, Jr. | 52/126.6 |
| 4,277,923 | 7/1981 | Rebentisch et al. | 52/126.6 |

FOREIGN PATENT DOCUMENTS

| | | | |
|---|---|---|---|
| 1358454 | 3/1964 | France | 52/802 |
| 1389020 | 7/1965 | France | 52/802 |
| 90081 | 10/1967 | France | 52/802 |

*Primary Examiner*—James L. Ridgill, Jr.
*Attorney, Agent, or Firm*—Kanz, Scherback & Timmons

[57] ABSTRACT

A floor panel for use in elevated floor assemblies is disclosed which includes a core member, a top sheet and a bottom sheet positioned on opposed sides of the core member and a flexible edge member operatively positioned between the top and bottom sheet. The bottom sheet has an upwardly deflected edge which forms a first shoulder. The top sheet includes a central section, an edge section and a connecting section operatively connecting the central section to the edge section. The edge section is positioned inboard of and below the first shoulder and forms an opening therebetween. The flexible edge member includes a portion which extends through the opening and an outer shoulder which engages the first shoulder. Edge member also includes an inner groove which is configured to receive the edge section therein. In addition, various abutment surfaces on the flexible edge member interface with various portions of the top and bottom sheet to limit rotation thereof from torsional forces applied to the flexible edge member.

9 Claims, 3 Drawing Figures

FLOOR PANEL

DESCRIPTION

1. Technical Field

The present invention relates in general to structural panels for buildings or the like, and more particularly to a novel and improved floor panel for use in floor assemblies or structures known commonly as: elevated or raised floors, access floors, false floors or pedestal floors.

Elevated or raised access floor assemblies usually consist of a plurality of rectangular or square floor panels which are supported above the base floor structure or foundation of the building by pedestals. It has become customary to support individual floor panels at the panel corners with pedestals which are separately adjustable in length so that each pedestal may be adjusted to compensate for any variations in the actual level of various areas of the base floor from a nominal level. The panels must be strong enough to support the weights of the equipment, furniture and personnel which may be positioned on the floor assembly.

The advent of the computer and its increased acquisition and usage by businesses has made the elevated or raised access floor not only desirable but a necessity in order to provide a clear and unobstructed floor for the operators and support personnel. The large number of electrical cables and wires for the computers and accessory equipment are placed under the raised access floor where they do not interfere with the day-to-day operation yet there is access to the cables and wires at any point in the access floor for inspection, cleaning, rerouting, repair and replacement. At the same time, the air plenum defined by the base floor, the raised access floor and the surrounding walls serve as a convenient means of providing air at controlled temperature to the computer equipment and the room.

Raised access floors are also becoming more attractive for use in applications other than computer and data processing rooms. The raised access floor is more desirable in comparison to conventional buildings where piping for various uses, ducting, wiring, cables, etc., are installed within the floors or ceilings which provide little or no access thereto without considerable difficulty.

2. Background Art

It is well known in the art to provide the floor panels with some type of resilient cushioning means positioned around the edge portion of the floor panel.

U.S. Pat. No. 3,548,559 discloses a floor panel having a flat upper sheet and a bottom pan section having flanges turned upwardly. A flexible edge member is disposed between the edge of the flanges and the edge of the flat upper sheet. Under some forces, the edge member would have a tendency to rotate to the outside of the panel thus deforming in shape and possibly slipping out of the floor panel.

U.S. Pat. No. 4,085,557 also discloses a floor panel having a flat upper sheet and a bottom pan section having flanges turned upwardly. A flexible edge member is disposed between the edge of the flanges and the edge of the flat upper sheet. Under some forces, the edge member has a tendency to deform in shape and possibly slip down between the two edges.

U.S. Pat. No. 4,295,319 discloses a floor panel having a flat upper sheet whose outer edge is turned downwardly and a bottom pan section having flanges turned upwardly. A flexible edge member is disposed between the edge of the flanges and the downwardly turned edge of the flat upper sheet. Although this edge member operates satisfactorily for most forces which are applied, there is still room for improvement to the edge member and its interaction with the edge of the flange and the downwardly turned edge of the flat upper sheet.

The present invention as claimed is intended to provide a solution to various prior art deficiencies including the tendency for a downwardly directed force, such as might be supplied by heavy equipment, to dislodge the edge member and push it downwardly between the top edge of the bottom pan and the edge of the top sheet and not remain essentially flush with the top surface of the floor panel. There is also the tendency for an inwardly directed rotational force, when applied to the edge member, to turn or rotate the edge member toward the central portion of the floor panel and deforming the edge member to the extent that the edge member will slip from its installed position in the panel. There is also the tendency for an outwardly directed rotational force, when applied to the edge member, to turn or rotate the edge member away from the central portion of the floor panel and deforming the edge member to the extent that the edge member will slip from its installed position in the panel.

DISCLOSURE OF INVENTION

The present invention provides a floor panel for use in elevated floor assemblies with said floor panel including a core member sandwiched between a top sheet and a bottom sheet. The bottom sheet includes a central section, which lies generally in a first plane, and an upwardly deflecting side which is spaced from the edge surface of the core member. The end portion of the deflecting side defines a first shoulder or support surface which lies in a second plane. The top sheet includes a central portion which lies generally in a third plane which is generally parallel to said first plane. The top sheet further includes an edge section and a connecting section which operatively connects said central section to said edge section. The edge section lies generally in a fourth plane which is parallel to said second plane and lies between said first plane and said second plane while being positioned between the upwardly deflecting side and the edge surface of the core member. Also included is a flexible edge member which is wedged into a predetermined position in the opening formed by the upwardly deflecting side of the bottom sheet and the edge and connecting sections of the top sheet. The flexible edge member has an outer shoulder which operatively engages the first shoulder on the bottom sheet. The edge member also includes an outer abutment surface which operatively contacts an inner abutment surface formed adjacent the first shoulder on the upwardly deflecting side of the bottom sheet. The lower portion of the edge member contains an inner horizontal channel which is configured to receive the edge section. In addition, one embodiment of the edge member includes an inner abutment surface which operatively contacts the connecting section of the top panel. Another embodiment, has an inner abutment surface which contacts the edge of the material covering the top surface of the top sheet.

Among the advantages offered by the claimed invention is the provision of a floor panel which is capable of supporting heavy equipment wherein the edge member is not easily deformed in such a manner as to cause it to slip from the opening between the top and bottom sheets of the panel. The edge member protects the edges of the panel and the edges of the covering on the top of the top sheet during installation and removal of the panel and virtually eliminates the dislodgment of the edge member during these operations. The edge member resists rotational forces which are applied to it, to the extent it does not easily become dislodged from its operational position. The edge member is not easily dislodged by a force in the vertical direction. The claimed invention presents a smooth, continuous upper surface across all the panels and provides a seal between floor panels.

Examples of the more important features of this invention have thus been summarized rather broadly in order that the detailed decription thereof that follows may be better understood, and in order that the contribution to the art may be better appreciated. There are, of course, additional features of the invention that will be described hereinafter and which will also form the subject of the claims appended hereto. Other features of the present invention will become apparent with reference to the following detailed description of a presently preferred embodiment thereof in connection with the accompanying drawings, wherein like reference numerals have been applied to like elements, in which:

BEST MODE FOR CARRYING OUT THE INVENTION

Figure 1:
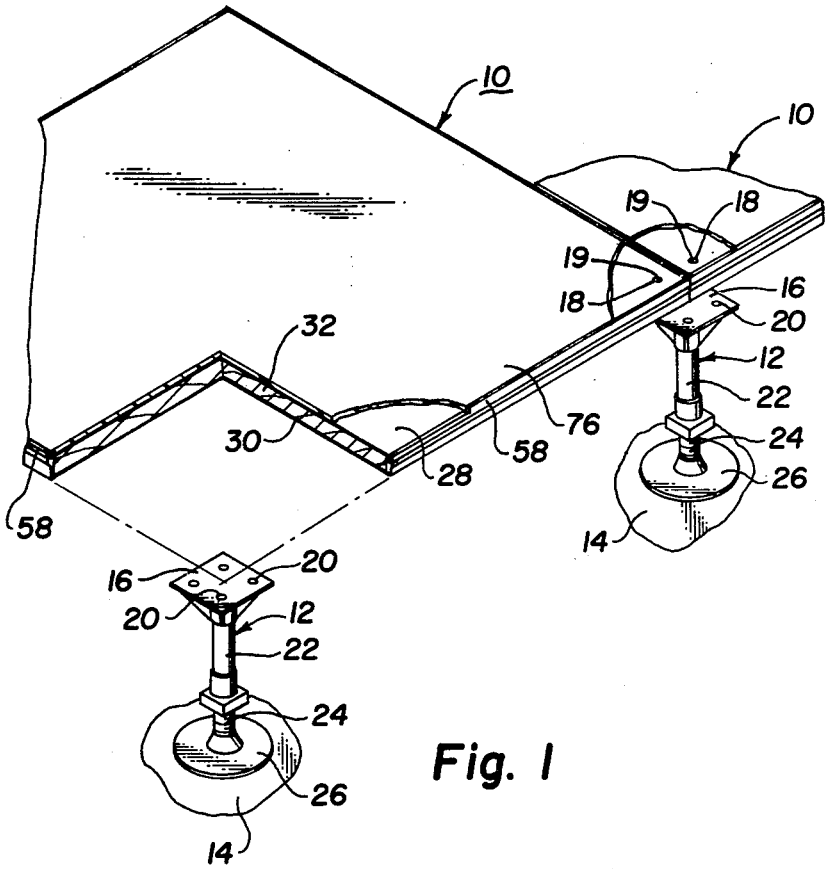
FIG. 1 is a simplified view from the top perspective showing the floor panel mounted on a typical pedestal and having parts broken away to more clearly illustrate the details.
Figure 2:
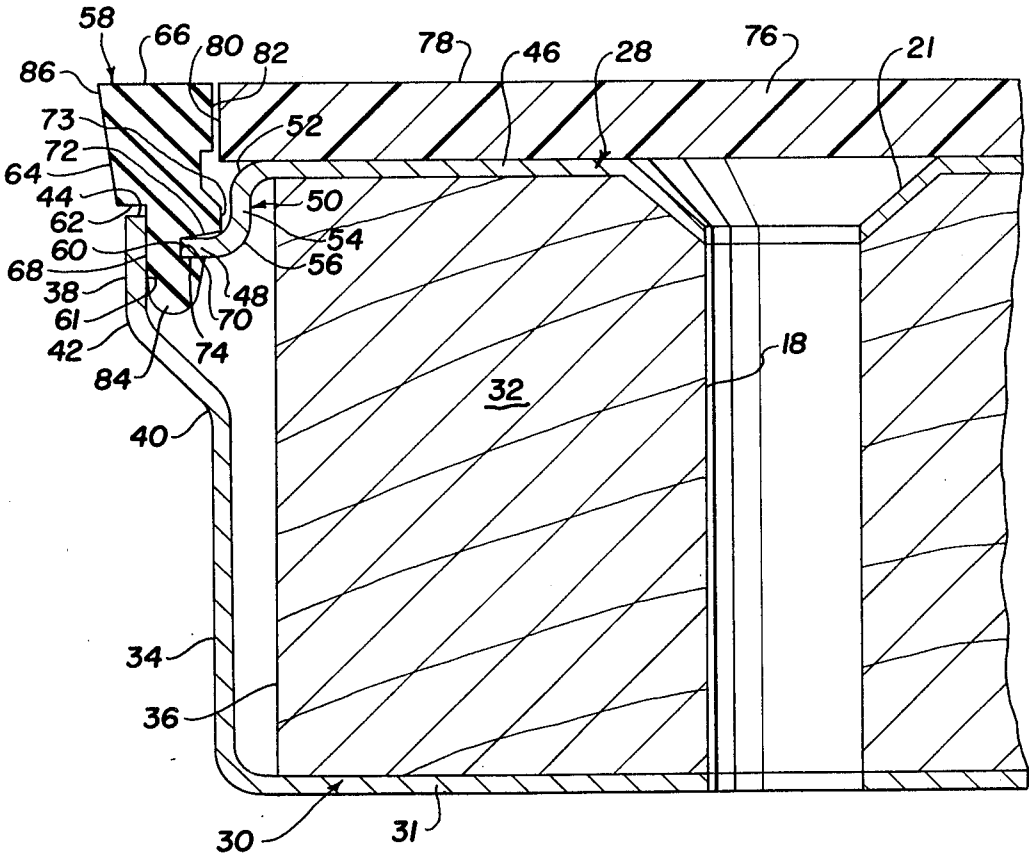
FIG. 2 is simplified view in section showing the construction details of the edge of one embodiment of the floor panel.

Referring to FIGS. 1 and 2, an exemplary elevated or raised access floor is shown as being constructed of floor panels 10 which are suspended on pedestals 12 resting on an existing base floor 14. The floor panels 10 have the corner sections suspended on the flat upper heads 16 of pedestals 12. In some installations, stringers (not shown) are secured between pedestals 12 for supporting the edge of the floor panels 10 along the entire length thereof. Apertures 18 are provided through the floor panels 10 at the corners thereof to be in alignment with apertures 20 located in the flat heads 16. Fasteners 19 are operatively positioned through apertures 18 and 20 to tie the floor panels 10 to the pedestals 12 and provide greater stability to the floor assembly. Apertures 18 include countersunk areas 21 at the top sheet 28 of the floor panels 10 so the flat tops of the fasteners 19 will be flush with the upper surface 78 of the top sheet 28. Apertures 20 may be threaded so the fasteners 19 may thread directly into the flat head 16. Pedestals 12 are preferably secured to the base floor 14 by fasteners or adhesives. Pedestals 12 are generally adjustable in the vertical direction by upper stem 22 which is threadably secured to a lower stem 24 which in turn is secured to a base 26. A flat head 16 is secured to upper stem 22. The overall height of the raised access floor, which is formed by floor panels 10, from the base floor 14 may be adjusted by rotating upper stem 22 to move either up or down.

Floor panels 10 are generally square in shape, although they may be rectangular, and have a top sheet 28 and a bottom sheet or pan 30 secured on opposite sides of a noncompressible core member 32. The top and bottom sheets 28 and 30, respectively, are generally formed from metal. The noncompressible core member 32 generally comprises a product of wood such as particle or chip board or, in some cases, a solid block of wood. Top and bottom sheets 28 and 30 may be secured to the top and bottom surfaces, respectively, of core member 32 by an adhesive such as contact cement. Bottom sheet or pan 30 includes a central section 31 which covers the bottom surface of core member 32, and an upwardly deflected side 34 which is spaced from the outer edge 36 of core 32 to allow for manufacturing irregularities. Central section 31 is generally planar and lies in a first plane. Side 34 is deflected at points 40 and 42 to position the upper portion 38 at a predetermined distance from the outer edge 36 of core member 32 with upper portion 38 being a greater distance from the outer edge 36 than the remaining portions of side 34. The upper end of upper portion 38 forms a first shoulder or support surface 44 which lies generally in a second plane. Upper portion 38, from first shoulder or support surface 44 to point of deflection 42, is generally planar and is generally parallel to outer edge 36 of core member 32 but perpendicular to first and second planes.

Top sheet 28 is generally attached to the top surface of core member 32 and includes a central section 46, an edge section 48 and a connecting section 50 operatively connecting the edge section 48 and the central section 46. Central section 46 lies generally in a third plane which is parallel to said first and second planes and is generally the same in surface area as the top surface of core member 32. Edge section 48 is generally planar and lies in a fourth plane which lies between the first and second planes and is generally parallel to planes 1–3. Edge section 48 extends toward upper portion 38 (of upwardly deflected side 34) a predetermined distance to provide a predetermined gap or space therebetween. Connecting section 50 is generally S-shaped in profile and operatively connects central section 46 and edge section 48. Connecting section 50 comprises a first curved-section 52, a straight section 54 and a second curved-section 56. Straight section 54 lies generally in a plane which is perpendicular to planes 1–4.

A flexible edge member 58 is secured in the gap or space between the end 60 of edge section 48 and the inner abutment surface 61 of upper portion 38. The flexible edge member 58 is generally t-shaped and fabricated of a strong flexible material such as vinyl or rubber. Flexible edge member 58 has an outer shoulder 62 formed in the peripheral side 64 below the upper surface 66. Outer shoulder 62 is configured to engage first shoulder or support surface 44 of upper portion 38. An outer abutment surface 68 is formed adjacent to and below outer shoulder 62 and is configured to engage the inner abutment surface 61 of upper portion 38. A relatively narrow but deep channel or groove 70 is formed in the inner side of edge member 58 and in the lower portion thereof. The depth of the channel or groove 70 is generally greater than the width thereof. The width of the groove or channel 70 is generally very near or only slightly wider than the thickness of edge section 48. The upper lip 72 of channel or groove 70 is longer than lower lip 74. Upper lip 72 may be of such a length and configuration that end surface 73 thereof abuts straight section 54 of connecting section 50. Edge section 48 is positioned within channel or groove 70. Flexible edge member 58 is configured such that when edge member 58 is in operative position, as generally shown in FIG. 2, upper surface 66 is coplanar with the upper surface 78 of tread surface or material 76. Tread material or surface 76, such as vinyl, rubber or tile is adhered to the top surface of the central section 46 of top sheet 28. Tread material or surface 76 extends slightly beyond core member 32. Outer-edge surface 80 of tread material 76 generally abuts the inner-edge surface 82 of edge member 58. Flexible edge member 58 is configured such that peripheral side 64 slopes outwardly as the peripheral side 64 extends from outer shoulder 62 to upper surface 66. The slope of peripheral side 64 is 2 to 4 degrees as measured outwardly from a generally vertical plane formed by upper portion 38.

Flexible edge member 58 is installed in floor panel 10 by inserting curved end 84 into the opening formed by end 60 of edge section 48 and the inner abutment surface 61 of upper portion 38 and applying a force to cause curved end 84 to squeeze through the opening whereupon channel or groove 70 will be positioned around edge section 48 as generally shown in FIG. 2. Outer shoulder 62 will be positioned against first shoulder 44 of upper portion 38 and inner surface 82 will abut outer surface 80 of tread surface 76. As the floor panels 10 are installed in a side-by-side relationship to form a floor assembly or structure, upper portion 86 of peripheral side 64 will abut against the corresponding portion of the flexible edge member of the adjacent floor panel such that a horizontal inward pressure will be asserted against flexible edge member 58 causing inner surface 82 to apply pressure against outer surface 80 of tread surface 76. In effect, the two adjacent edge members are squeezed between the two tread surfaces.

As pressure is applied to flexible edge member 58 by man or machinery in the form of a straight downward force, this type of force is resisted by outer shoulder 62 engaging first shoulder 44 of upper portion 38 and the channel surface of upper lip 72 engaging the adjacent side of edge section 48. There will also be some frictional force between upper portions 86 of adjacent edge members which will resist any downward movement of edge member 58. If the applied pressure is in the form of a torsional force in a counter-clockwise direction, this type of force is resisted by outer shoulder 62 engaging first shoulder 44 of upper portion 38 and the channel surface of lower lip 74 engaging the adjacent side of edge section 48. There will also be a side force applied against upper portion 86 by the corresponding portion of the adjacent edge member. If the applied pressure is in the form of a torsional force in a clockwise direction, this type of force is resisted by outer abutment surface 68 engaging inner abutment surface 61 of upper portion 38, inner surface 82 engaging outer surface 80 of tread surface 76 and the channel surface of upper lip 72 engaging the adjacent side of edge section 48. If the applied pressure is in the form of a straight upward force (which would not normally occur in normal usage of the floor), this type of force is resisted by the channel surface of lower lip 74 engaging the adjacent side of edge section 48 and the outer abutment surface 68 engaging inner abutment surface 61 of upper portion 38.

Figure 3:
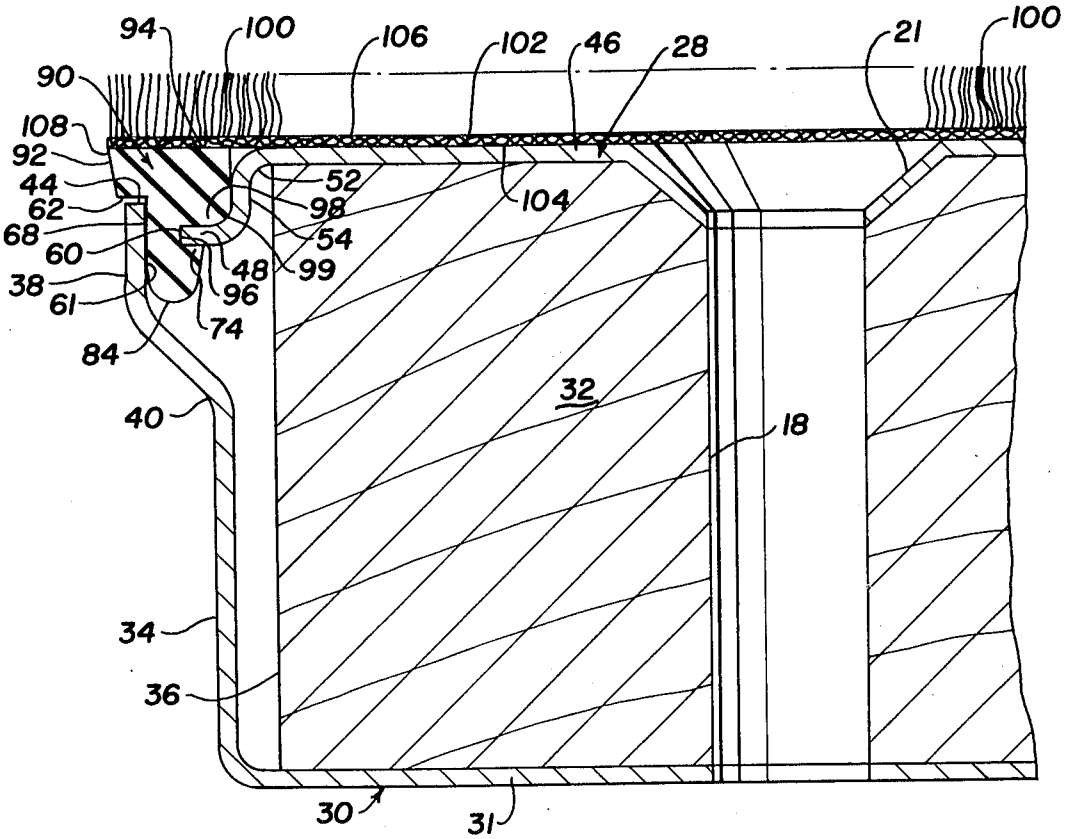
FIG. 3 is a simplified view in section showing the construction details of the edge of another embodiment of the floor panel.

An alternative embodiment of the invention is illustrated in FIG. 3. Many of the elements and relationships discussed with reference to FIG. 2, which are duplicated in the embodiment of FIG. 3, will not be repeated here in order to reduce duplication. The alternative embodiment of FIG. 3 differs from the embodiment of FIG. 2 in the shape of the flexible edge member and the tread surface or material installed on the top sheet of floor panel 10. The tread surface or material is carpet 100.

A flexible edge member 90 is secured in the gap or space between the end 60 of edge section 48 and the inner abutment surface 61 of upper portion 38. The flexible edge member 90 is generally t-shaped and fabricated of a strong flexible material such as vinyl or rubber. Flexible member 90 has an outer shoulder 62 formed in the peripheral side 92 below the upper surface 94. Outer shoulder 62 is configured to engage first shoulder or support surface 44 of upper portion 38. An outer abutment surface 68 is formed adjacent to and below outer shoulder 62 and is configured to engage the inner abutment surface 61 of upper portion 38. A relatively narrow but deep channel or groove 96 is formed in the inner side of edge member 90 and in the lower portion thereof. The depth of the channel or groove 96 is generally greater than the width thereof. The width of the groove or channel 96 is generally very near or only slightly wider than the thickness of edge section 48. The upper lip 98 of channel or groove 96 is longer than lower lip 74. Upper lip 98 is of such a length and configuration that its outer surface 99 is in contact with the outer surface of edge section 48, the second curved section 56 of connecting section 50 and straight section 54 of connecting section 50. Edge section 48 is positioned within channel or groove 96. Flexible edge member 90 is configured such that when edge member 90 is in operative position as generally shown in FIG. 3, upper surface 94 is coplanar with the upper surface 102 of central section 46 of top sheet 28. In this way, the lower surface 104 of backing material 106 is coplanar and rests on the central section 46 of top sheet 28 with the outer edge portion of the backing material 106 resting on upper surface 94 of edge member 90. Backing material 106 is normally adhered to the top surface of central section 46. Flexible edge member 90 is configured such that peripheral side 92 slopes outwardly as the peripheral side 92 extends from outer shoulder 62 to upper surface 94. The slope of peripheral side 92 is 2 to 4 degrees as measured outwardly from a generally vertical plane formed by upper portion 38.

Flexible edge member 90 is installed in floor panel 10 by inserting curved end 84 into the opening formed by end 60 of edge section 48 and the inner abutment surface 61 of upper portion 38 and applying a force to cause curved end 84 to squeeze through the opening whereupon channel or groove 96 will be positioned around edge section 48 as generally shown in FIG. 3. Outer shoulder 62 will be positioned against first shoulder 44 of upper portion 38. As the floor panels 10 are installed in a side-by-side relationship to form a floor assembly or structure, upper portion 108 of peripheral side 92 will abut against the corresponding portion of the flexible edge member of the adjacent floor panel such that a horizontal inward pressure will be asserted against flexible edge member 90 causing outer surface 99 of upper lip 98 to apply pressure against connecting section 50.

As pressure is applied to flexible edge member 90 by man or machinery in the form of a straight downward force, this type of force is resisted by outer shoulder 62 engaging first shoulder 44 of upper portion 38 and the channel surface of upper lip 98 engaging the adjacent side of edge section 48. There will also be some frictional force between upper portions 108 of adjacent edge members which will resist any downward movement of edge member 90. If the applied pressure is in the form of a torsional force in a counter-clockwise direction, this type of force is resisted by outer shoulder 62 engaging first shoulder 44 of upper portion 38 and the channel surface of lower lip 74 engaging the adjacent side of edge section 48. There will also be a side force applied against upper portion 108 by the corresponding portion of the adjacent edge member. If the applied pressure is in the form of a torsional force in a clockwise direction, this type of force is resisted by outer abutment surface 68 engaging inner abutment surface 61 of upper portion 38, outer surface 99 engaging outer surface of edge section 48, the second curved section 56 of connecting section 50 and straight section 54 of connecting section 50. If the applied pressure is in the form of a straight upward force (which would not normally occur in normal usage of the floor), this type of force is resisted by the channel surface of lower lip 74 engaging the adjacent side of edge section 48 and the outer abutment surface 68 engaging inner abutment surface 61 of upper portion 38.

It will be appreciated that the invention provides an improved floor panel for use in elevated floor assemblies which is capable of supporting heavy equipment. The unique configurations of the floor panel and the included flexible edge member together with their interacting relationships allow the floor panel to be subjected to the forces encountered in normal usage without deforming the edge member in such a manner as to cause the edge member to slip from its sealing position in the floor panel.

Thus it is apparent that there has been provided in accordance with this invention, a floor panel and included edge member that substantially incorporates the advantages set forth above. Although the present invention has been described in conjunction with specific forms thereof, it is evident that many alternatives, modifications, and variations will be apparent to those skilled in the art in light of the foregoing disclosure. Accordingly, this description is to be construed as illustrative only and is for the purpose of teaching those skilled in the art the manner of carrying out the invention. It is understood that the forms of the invention herewith shown and described are to be taken as the presently preferred embodiments. Various changes may be made in the shape, size and arrangement of parts. For example, equivalent elements may be substituted for those illustrated and described herein, parts may be reversed, and certain features of the invention may be utilized independently of features of the invention. It will be appreciated that the various modifications, alternatives, variations, etc. may be made without departing from the spirit and scope of the invention as defined in the appended claims.

I claim:

1. A floor panel for use in elevated floor assemblies, said panel comprising:

(a) a core member having a bottom, a top and a side connected between said bottom and said top;

(b) a bottom sheet having a central section lying in a first plane and an upwardly deflected edge portion formed about a periphery of said central section, said upwardly deflected edge portion forming a first shoulder lying in a second plane, a predetermined portion of said central section being in contact with said bottom of said core member, said upwardly deflected edge portion being spaced a predetermined distance from the side of said core member;

(c) a top sheet having a central section lying in a third plane, an edge section lying generally in a fourth plane which is generally parallel to said second plane and is positioned between said second plane and said central section of said bottom sheet, and a connecting section operatively connecting said central section of said top sheet with said edge section, said edge section having an end of predetermined shape and being positioned inboard of and below said first shoulder and forming an opening therebetween, said connecting section and said edge section being spaced a predetermined distance from the side of said core member; and (d) a flexible edge member having a portion thereof extending through said opening and having an outer shoulder engaging said first shoulder, said flexible edge member having an inner groove being configured to receive said edge section therein to sustain a downward force on said flexible edge member, said inner groove including a portion to mate with said end of predetermined shape to sustain a rotational force on said flexible edge member, said flexible edge member being spaced a predetermined distance from the side of said core member, whereby said flexible edge member is supported entirely by said upwardly deflected edge portion and said edge section.

2. The floor panel of claim 1, further including an adjustable pedestal comprising;

(a) a base member having an upwardly extending threaded stud;

(b) a hollow tubular upper member having a threaded passage adapted to move over said threaded stud of said base member; and (c) a head adapted to support a corner of said floor panel.

3. The floor panel of claim 1 further including an outer abutment surface formed on said flexible edge member adjacent said outer shoulder, said outer abutment surface engaging a juxtaposed portion of said upwardly deflected edge portion to prevent rotation of said flexible edge member.

4. The floor panel of claim 1 further including an end surface formed on said flexible edge member adjacent and above said inner groove, said end surface engaging a juxtaposed portion of said connecting section to prevent rotation of said flexible edge member.

5. The floor panel of claim 1, further including an upper surface formed on said flexible edge member, said upper surface being coplanar with the upper surface of said top sheet.

6. The floor panel of claim 1 further including an upper surface formed on said flexible edge member and a cover material placed upon said top sheet, said cover material including an upper surface, said upper surface formed on said flexible edge member being coplanar with the upper surface of said cover material.

7. The floor panel of claim 6, further including an inner-edge surface formed on said flexible edge member adjacent said inner groove, said inner-edge surface engaging a juxtaposed portion of said cover material placed upon said top sheet.

8. The floor panel of claim 1, wherein said connecting section is generally S-shaped in profile.

9. The floor panel of claim 8, wherein a planar portion of said connecting section is lying in a fifth plane, said fifth plane being generally perpendicular to said first and second planes.

* * * * *